United States Patent [19]

Sugino

[11] Patent Number: 4,856,924

[45] Date of Patent: Aug. 15, 1989

[54] PRINTER

[75] Inventor: Kouichi Sugino, Tokyo, Japan

[73] Assignee: Seikosha Co., Ltd., Japan

[21] Appl. No.: 65,361

[22] Filed: Jun. 23, 1987

[30] Foreign Application Priority Data

Jun. 23, 1986 [JP] Japan ..... 61-146745

[51] Int. Cl.[4] ..... B41J 19/50

[52] U.S. Cl. ..... 400/283; 400/279; 400/303; 400/477; 400/703

[58] Field of Search ..... 400/279, 283, 100, 303, 400/703, 472, 477, 705, 294

[56] References Cited

U.S. PATENT DOCUMENTS

| | | | |
|---|---|---|---|
| 3,838,250 | 9/1974 | Naas et al. | 400/705 |
| 4,184,781 | 1/1980 | Ota | 400/703 |
| 4,378,553 | 3/1983 | McCall | 400/477 |

FOREIGN PATENT DOCUMENTS

| | | | |
|---|---|---|---|
| 1126269 | 11/1956 | France | 400/100 |
| 144188 | 11/1980 | Japan | 400/703 |

OTHER PUBLICATIONS

Kolpek, "Low Cost Display . . . ", IBM Technical Disclosure Bulletin, vol. 19, No. 2, p. 563, Jul. 76.

Bowles, "Input Tab . . . Typewriter", IBM Technical Disclosure Bulletin, vol. 20, No. 11B, pp. 4858–4859, 4–78.

Greene, "Error Communication . . . ", IBM Technical Disclosure Bulletin, vol. 23, No. 9, p. 3986, 2–81.

"Rectilinear Pointing Device", IBM Technical Disclosure Bulletin, vol. 29, No. 10, pp. 4651–4652, 3–87.

"Adding Temporary Function . . . ", IBM Technical Disclosure Bulletin, vol. 28, No. 10, pp. 4545–4546, 3–86.

*Primary Examiner*—William Pieprz

*Attorney, Agent, or Firm*—Bruce L. Adams; Van C. Wilks

[57] ABSTRACT

According to the present invention, setting contents of a specified mode are selected in accordance with positions to which a printing head shifts, and the setting contents are set by operating switches in those positions. A switch for shifting the printing head and a setting switch serve as switches for executing other functions peculiar to a printer.

5 Claims, 2 Drawing Sheets

PRINTER

DETAILED DESCRIPTION OF THE INVENTION

1. Technical Field of the Invention

The present invention relates to a printer.

2. Description of the Related Art

A conventional printer is equipped with a small number of indispensable specific operating switches which include a switch for specifying ON-line/OFF-line, a selecting switch for draft/NLQ (Near Letter Quality), a form-feed switch and a line-feed switch.

Besides the above-described printer, there is another type of a printer provided with additional modes such as to set a character pitch, types of characters (stress, double printing and so on) and a length of printing paper.

OBJECT OF THE INVENTION

The foregoing printer provided with the additional modes has to be equipped with switches appropriated to the setting of those modes and with lamps for displaying the setting contents. For instance, the printer having a character pitch setting mode includes display units for displaying the setting contents such as 10 CPI (Character Per Inch), 12 CPI, 17 CPI and so forth; the selection of the lamps is made by sequentially turning on the lamps of individual display units with the aid of the appropriate switches, thereby setting desired contents. For this reason, the appropriate switches and lamps are required, which lead to an increase in cost.

The present invention aims at setting the specified modes without employing the appropriate switches and lamps and bringing about a descrease in cost.

DESCRIPTION OF THE PREFERRED EMBODIMENT

Figure 1:
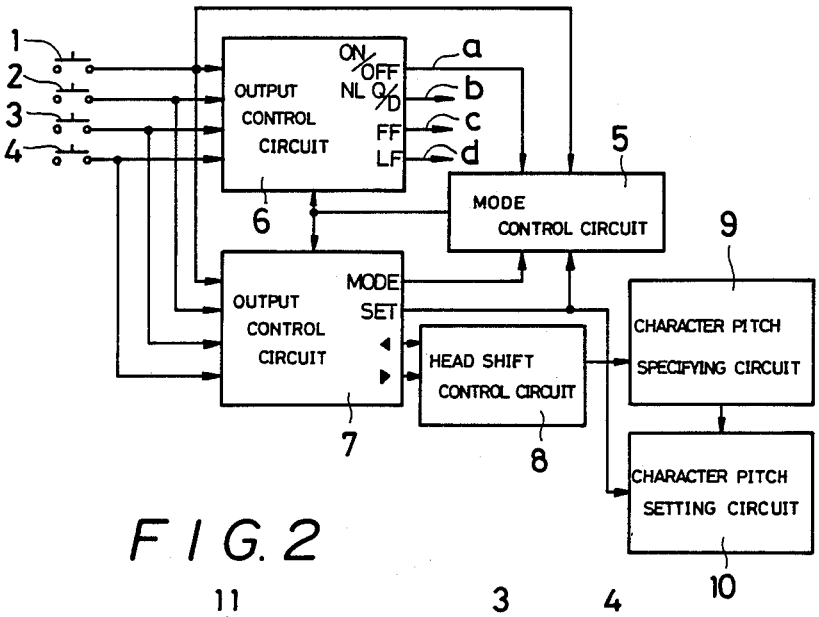
FIG. 1 is a functional block diagram, showing one embodiment of the present invention.
Figure 2:
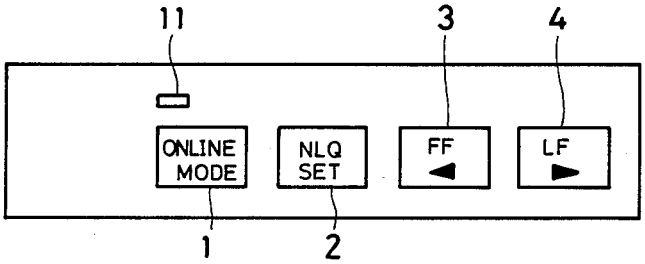
FIG. 2 is a front view showing one embodiment of an operating panel.

In FIG. 1, the numerals 1 to 4 denote operating switches needed on a printer, which include an ON-line/OFF-line selecting switch 1, an NLQ/draft selecting switch 2, a form-feed executing switch 3 and a line-feed executing switch 4. The individual switches 1–4 perform additional functions as a mode change-over switch, a character pitch setting switch, a printing head left-shifting switch and a printing head right-shifting switch. These switches 1–4 are disposed on a panel as shown in FIG. 2. The numeral 5 represents a mode control circuit for changing over the functions of the respective switches 1–4. An output control circuit 6 produces outputs when executing the original functions of the respective switches 1–4, and another output control circuit 7 generates outputs when the switches 1–4 perform the additional functions in the setting mode of the character pitch. The numeral 8 represents a head shift control circuit for controlling the shift of a displaceable printing head 12; the numeral 9 stands for a specifying circuit for specifying the character pitch; and 10 designates a character pitch setting circuit.

Referring to FIG. 2, there is shown a lamp marked with the numeral 11 which is turned on at an ON-line time.

Next, the operations of the printer will hereinafter be described with reference to FIGS. 3, 4. The output control circuit 6 is selected in a normal mode in response to the outputs of the mode control circuit 5, and the switches 1 to 4 perform their original or normal functions. To be more specific, change-over outputs for the ON-line and OFF-line are produced from a terminal of the output control circuit 6 by operating the switch 1, whereby the change-over thereof is effected. The lamp 11 is turned on at the ON-line time.

On the other hand, selection outputs for the NLQ and the draft are generated from a terminal b of the circuit 6 by operating the switch 2, and the change-over thereof is carried out.

Furthermore, the outputs are generated from a terminal c of the circuit 6 by operating the switch 3, thereby effecting form-feed of recording paper. Upon a manipulation of the switch 4, outputs are produced from a terminal d of the circuit 6, whereby line-feed is performed.

The setting operations of the character pitch will be explained next. At first, an ON-line state (FIG. 4, a) is created by means of the switch 1, and the switch 1 then continues to be pushed (FIG. 4, b) for a given period, for instance, one second or more. With this process, the change-over outputs are generated from the mode control circuit 5, and the output control circuits 6, 7 are respectively brought into a non-operation state and an operation state. Namely, the functions of the switches 1 to 4 are changed over. Simultaneously, the lamp 11 illustrated in FIG. 2 begins to turn on and off according to the aforementioned change-over outputs. When the switch 3 is manipulated (FIG. 4, c), the printing head 12 shifts in the left-hand direction of FIG. 3 (FIG. 4, d). Upon an operation of the switch 4 (FIG. 4, e), the printing head 12 displaceably shifts in the right-hand direction of the Figure (FIG. 4, f).

Figure 3:
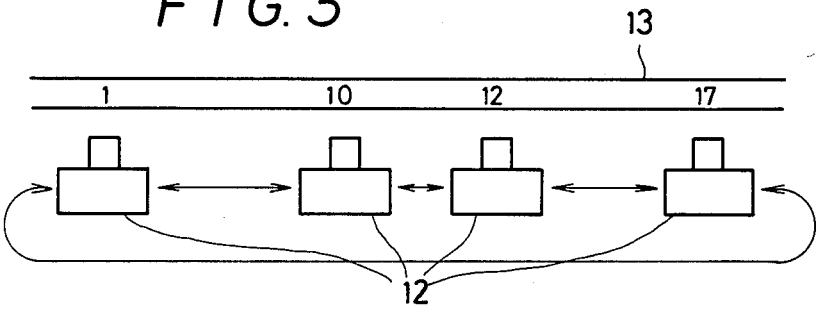
FIG. 3 is an explanatory view showing positions to which a printing head shifts.
Figure 4:
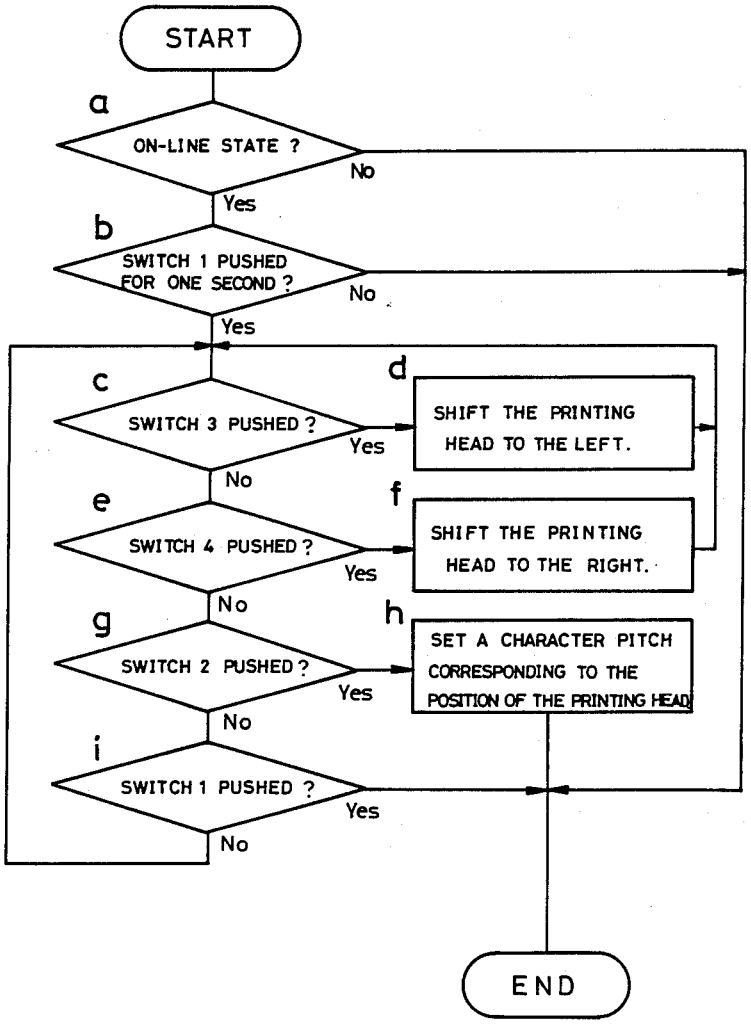
FIG. 4 is a flowchart showing the operations.

In FIG. 3, a paper holding bar 13 opposed to the printing head 12 is marked with the indexes 1, 10, 12 and 17 at the corresponding positions to which the printing head is selectively shifted. The index 1 indicates that the printing operation is effected at a character pitch according to a command given from a host computer. The indexes 10, 12, 17 indicate that the printing operation is effected at fixed character pitches such as 10 CPI, 12 CPI, 17 CPI, respectively, regardless of the command issued from the host computer.

Originally, the numeral indexes with which the holding bar is marked serve to exhibit the number of printing digits and the printing positions. Instead, another index system may be provided such that numeral indexes 1, 10, 20, . . . are simply arranged and therebetween are arranged the radated scale indexes.

Before effecting the printing operation at the character pitch of 10 CPI, for example, driving signals for the printing head 12 are generated from the head shift control circuit 8 as illustrated in FIG. 1 by operating the switches 3 and 4, thereby displaceably shifting the printing head 12 to the desired position indicated by the numeral index 10 of FIG. 3. At this time, the character pitch specifying circuit 9 produces character pitch data for specifying a desired character pitch, i.e., 10 CPI in this case, according to the position of the head 12. Then the foregoing data are set and stored in the character pitch setting circuit 10 (FIG. 4, h) by operating the switch 2 (FIG. 4, g). The outputs for changing over the setting mode are concurrently generated from the mode control circuit 5, and the normal mode is restored, whereby the individual switches 1–4 restore their original functions. The character pitch is thus set to 10 CPI, and the printing operation continues to be performed at 10 CPI regardless of the command issued from the computer.

In the case of setting the character pitch to 12 CPI or 17 CPI, the printing head is made to shift to the position indicated by the numeral index 12 or 17 of FIG. 3, and then the switch 2 may be operated.

When performing the printing at character pitches in accordance with the commands sent from the computer, the printing head is shifted to the position indicated by the numeral index 1, and the switch 2 may be manipulated.

In the above-described embodiment, the description is focused on a case where the character pitches are set in the setting mode. The application is not, however, limited to this case, but may extend to the setting of various printing forms including the types of characters such as stress and double printing and a length of the printing paper.

The present invention has the following effects. The contents of a given printing form are specified in accordance with the position to which the printing head shifts by operating the switch, and such contents are set by operating another switch. Hence, it is feasible to display the contents of the specified form with no addition of display units for displaying such contents. This arrangement contributes to simplicity in constitution and to a decrease in cost.

The switches needed to the printer serve as the switches for shifting the printing head and setting the contents, which brings about the reduction in cost. Therefore, still more excellent effects are obtained.

I claim:

1. In a serial printer having a displaceable printing head and being selectively operative in a setting mode for setting a variable character pitch and in a normal mode for effecting a printing operation according to the set character pitch: a plurality of manually operable switches each having assigned thereto a normal function which is performed when the switch is operated when the printer is in the normal mode and having assigned thereto a setting function which is performed when the switch is operated when the printer is in the setting mode, at least one of the switches having a setting function which effects selective displacement of the printing head to one of a plurality of predetermined positions each corresponding to a different character pitch; means for producing character pitch data effective to specify a desired character pitch according to the selected position to which the printing head is selectively displaced; and storage means operative when the printer is in the setting mode for setting therein the desired character pitch data for use during a printing operation of the printer in the normal mode.

2. A serial printer according to claim 1; including controlling means for controlling the serial printer to effect changeover between the normal mode and setting mode.

3. A serial printer according to claim 2; wherein one of the switches has a setting function which enables the controlling means to set the setting mode.

4. A serial printer according to claim 3; wherein two of the switches have setting functions which effect selective displacement of the printing head in opposite directions.

5. A serial printer according to claim 3; wherein one of the switches has a setting function which enables the storage means to set therein the desired character pitch data.

* * * * *